US009631450B2

(12) United States Patent
Sun et al.

(10) Patent No.: US 9,631,450 B2
(45) Date of Patent: Apr. 25, 2017

(54) SURFACE LAYER CONDUCTOR RUNNING TOOL FOR DEEP-WATER WELL DRILLING

(71) Applicant: China University of Petroleum (East China), Qingdao, Shandong (CN)

(72) Inventors: Baojiang Sun, Shandong (CN); Ning Zhang, Shandong (CN); Hao Li, Shandong (CN); Yonghai Gao, Shandong (CN); Guomin Yan, Shandong (CN); Mingzhao Huang, Tianjin (CN); Shuang Xu, Tianjin (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 15/270,537

(22) Filed: Sep. 20, 2016

(65) Prior Publication Data

US 2017/0089161 A1 Mar. 30, 2017

(30) Foreign Application Priority Data

Sep. 30, 2015 (CN) ..... 2015 1 0365639

(51) Int. Cl.

| | |
|---|---|
| ***E21B 7/12*** | (2006.01) |
| ***E21B 33/038*** | (2006.01) |
| ***E21B 19/00*** | (2006.01) |

(52) U.S. Cl.

CPC ..... *E21B 33/038* (2013.01); *E21B 7/12* (2013.01); *E21B 19/002* (2013.01)

(58) Field of Classification Search

CPC ..... E21B 7/12; E21B 17/046; E21B 17/20; E21B 19/002; E21B 19/16; E21B 33/038

See application file for complete search history.

(56) References Cited

U.S. PATENT DOCUMENTS

| | | | | |
|---|---|---|---|---|
| 4,813,496 | A * | 3/1989 | Rohweller | E21B 7/208 166/340 |
| 8,607,859 | B2 * | 12/2013 | Eriksen | E21B 7/20 166/177.4 |
| 8,839,880 | B2 * | 9/2014 | Trevino | E21B 7/20 166/242.6 |
| 9,121,238 | B2 * | 9/2015 | Ellison | E21B 23/04 |

* cited by examiner

*Primary Examiner* — Matthew R Buck

(74) *Attorney, Agent, or Firm* — Calfee, Halter & Griswold LLP

(57) ABSTRACT

The present invention relates to offshore oil and gas exploration drilling field and, in particular, to a surface layer conductor running tool for deep-water well drilling, which is used to run a conductor to a designated position, so that the drill stem can be released and the drilling can be continued. The surface layer conductor running tool for deep-water well drilling comprises a mandrel, an inner sleeve, an outer sleeve, and a main body, wherein the inner sleeve, the outer sleeve, and the main body are fitted over the mandrel sequentially; the inner sleeve can slide up and down but cannot rotate in relation to the mandrel, the outer sleeve and the inner sleeve are connected via a transmission thread pair, and the main body is situated on the inner sleeve; a retaining pawl penetrating the main body and radially slidable in horizontal direction; and an anti-rotation pin penetrating the main body and the outer sleeve, so that the outer sleeve can move up and down in the main body only, but cannot rotate.

8 Claims, 7 Drawing Sheets

SURFACE LAYER CONDUCTOR RUNNING TOOL FOR DEEP-WATER WELL DRILLING

CROSS REFERENCE TO RELATED APPLICATIONS

This application claims priority to Chinese Application No. 201510365639.4, filed on Sep. 30, 2015, entitled "Surface Layer Conductor Running Tool for Deep-Water Well Drilling", which is specifically and entirely incorporated by reference.

TECHNICAL FIELD

The present invention relates to offshore oil and gas exploration drilling field and, in particular, to a surface layer conductor running tool for deep-water well drilling, which is used to run a conductor to a designated position, so that the drill stem can be released and the drilling can be continued.

BACKGROUND

In offshore deep-water well drilling, a surface layer conductor is the first-layer conductor installed in the construction process of the entire deep-water oil well, and provides structural support for all follow-up conductors and wellhead equipment. Deploying a surface layer conductor by conductor jetting has advantages, for example, the drilling time can be saved, and well cementation or formation protection is not required. However, the conductor running work has to be carried out with the aid of an efficient and reliable running tool.

At present, the research on surface layer conductor running tools for deep-water well drilling is only in a starting stage in China. Most technical operators that employ the conductor jetting technology in deep-water well drilling in the South China Sea region are foreign oil companies, who only provide a field service but do not disclose the technology or sell products or tools, and keep secrete the key part and core data; in addition, their service charges are very high. Consequently, there are many difficulties in our deep-water well drilling operations.

SUMMARY

To overcome the drawbacks in the prior art, the present invention provides a surface layer conductor running tool for deep-water well drilling, which utilizes the drill stem to drive the lifting, lowering, and rotation of a mandrel, so that the conductor is locked to or released from the running tool.

To attain the object described above, the present invention provides a surface layer conductor running tool for deep-water well drilling, comprising: a mandrel, an inner sleeve, an outer sleeve, and a main body, wherein the inner sleeve, the outer sleeve, and the main body are fitted over the mandrel sequentially; the inner sleeve can slide up and down but cannot rotate in relation to the mandrel, the outer sleeve and the inner sleeve are connected via a transmission thread pair, and the main body is situated on the inner sleeve; a retaining pawl penetrating the main body and radially slidable in horizontal direction; and an anti-rotation pin penetrating the main body and the outer sleeve, so that the outer sleeve can move up and down in the main body only, but cannot rotate.

Compared with the prior art, the present invention has the following beneficial effects.

First, the surface layer conductor running tool for deep-water well drilling enables the conductor to be locked to or released from the running tool. Thus, the drilling tool can disengage from the conductor when the conductor is run to a predetermined depth, and further drilling can be continued.

Second, the upper part of the surface layer conductor running tool for deep-water well drilling employs a lateral flow-back hole design, which enables the drilling fluid carrying rock cuttings to flow back laterally, so as to prevent the rock cuttings from accumulating near the wellhead and hampering observation of the indication rod.

Third, the lower part of the surface layer conductor running tool for deep-water well drilling employs a rib plate structure design, which provides an effective supporting force for the main body of the tool, and prevents rotation of the running tool and the conductor head.

Figure 1:
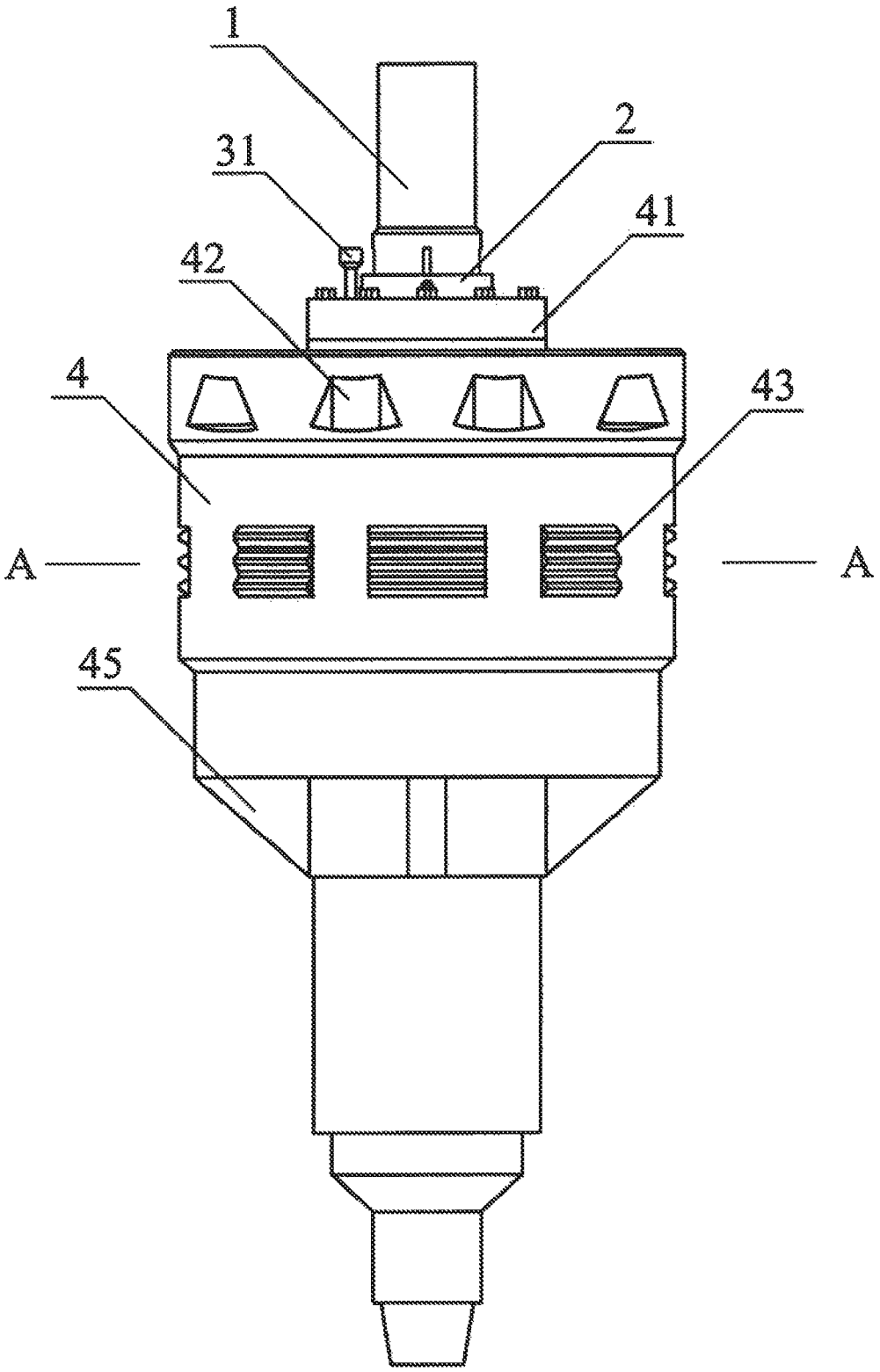
FIG. 1 is a schematic structural diagram of the surface layer conductor running tool for deep-water well drilling.
Figure 2:
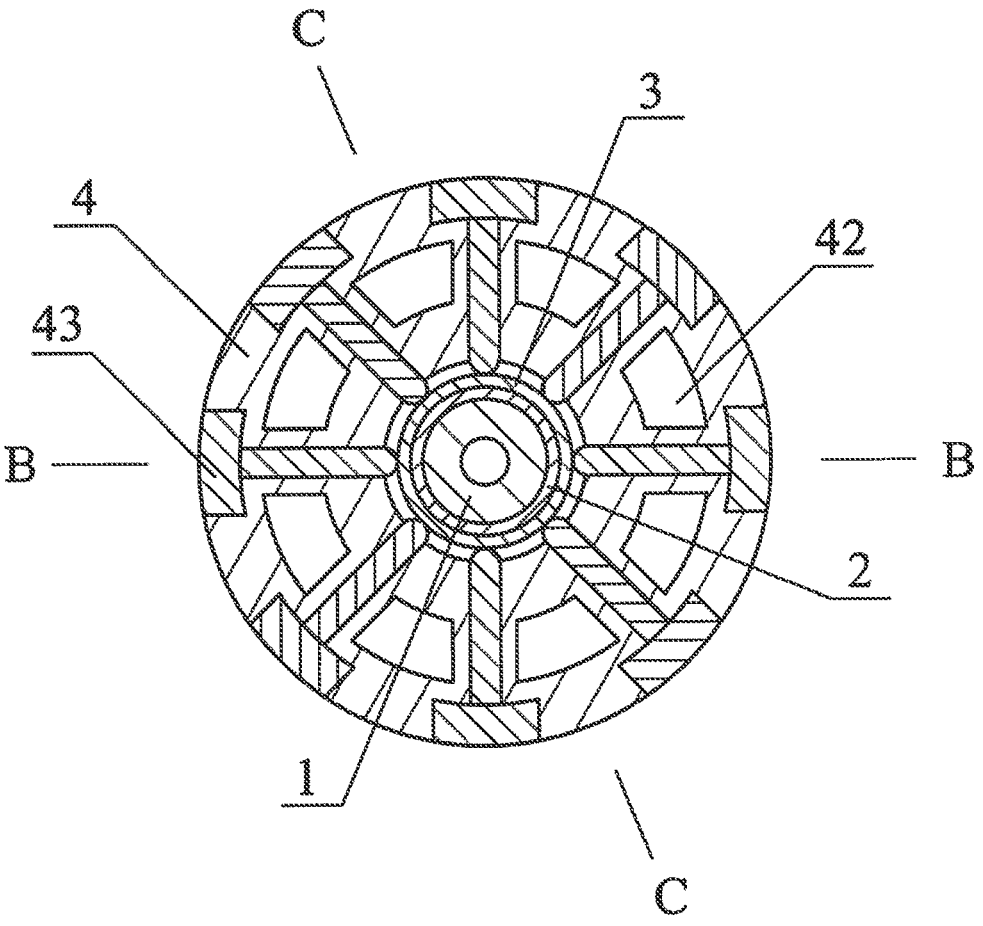
FIG. 2 is a sectional view taken along line A-A of the structure in FIG. 1.
Figure 3:
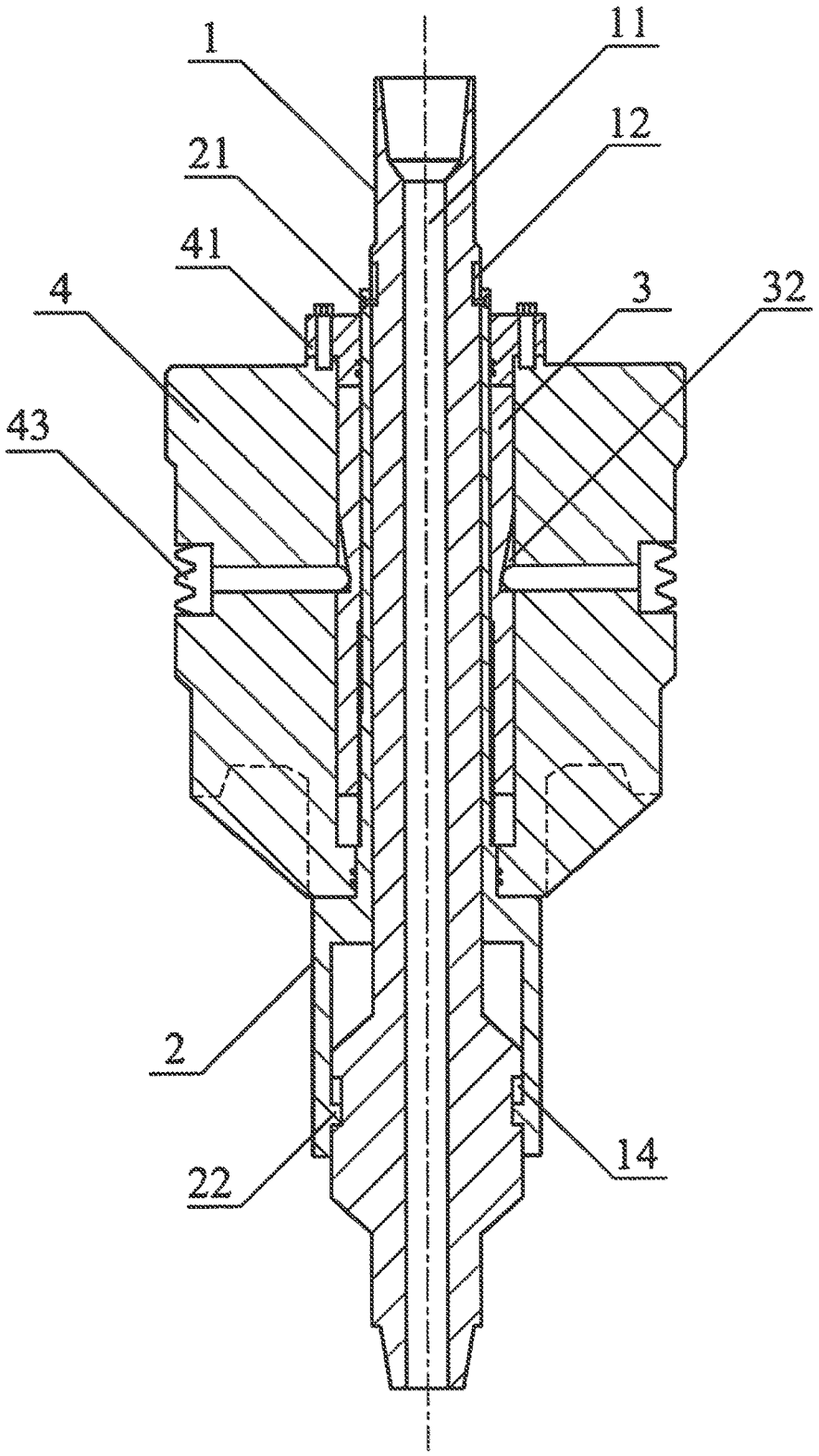
FIG. 3 is a sectional view taken along line B-B of the structure in FIG. 2.

The reference signs in the figures are explained as follows: 1-mandrel; 11-center hole; 12-vertical groove; 13-boss; 14-step groove; 2-inner sleeve; 21-shear pin; 22-positioning key; 3-outer sleeve; 31-indication rod; 32-reducing groove; 33-anti-rotation groove; 4-main body; 41-sealing cap; 42-flow-back hole; 43-retaining pawl; 44-anti-rotation pin; 45—rib plate; 5-conductor head; 51-annular groove; 52-inclined groove.

DETAILED DESCRIPTION OF THE EMBODIMENTS

As shown in FIGS. 1-4, the surface layer conductor running tool for deep-water well drilling comprises: a mandrel 1, an inner sleeve 2, an outer sleeve 3, and a main body 4, wherein the inner sleeve 2, the outer sleeve 3, and the main body 4 are fitted over the mandrel 1 sequentially; the inner sleeve 2 can slide up and down but cannot rotate in relation to the mandrel 1, the outer sleeve 3 and the inner sleeve are connected via a transmission thread pair, and the main body 4 is situated on the inner sleeve 2; and an anti-rotation pin 44 penetrating the main body 4 and the outer sleeve 3, so that the outer sleeve 3 an move up and down in the main body 4 only, but cannot rotate.

The mandrel 1 is a hollow mandrel, and has a center hole 11, which serves as a drilling fluid circulation channel; the upper end of the mandrel 1 has internal threads by which the mandrel 1 is connected with an upper drill stem, to control the operation of the tool by means of lifting, lowering, and rotation of the upper drill stem; the lower end of the mandrel 1 has external thread by which the mandrel 1 is connected with the lower drill stem and thereby is connected to a bottom-hole assembly via the lower drill stem for downward drilling.

Figure 5:
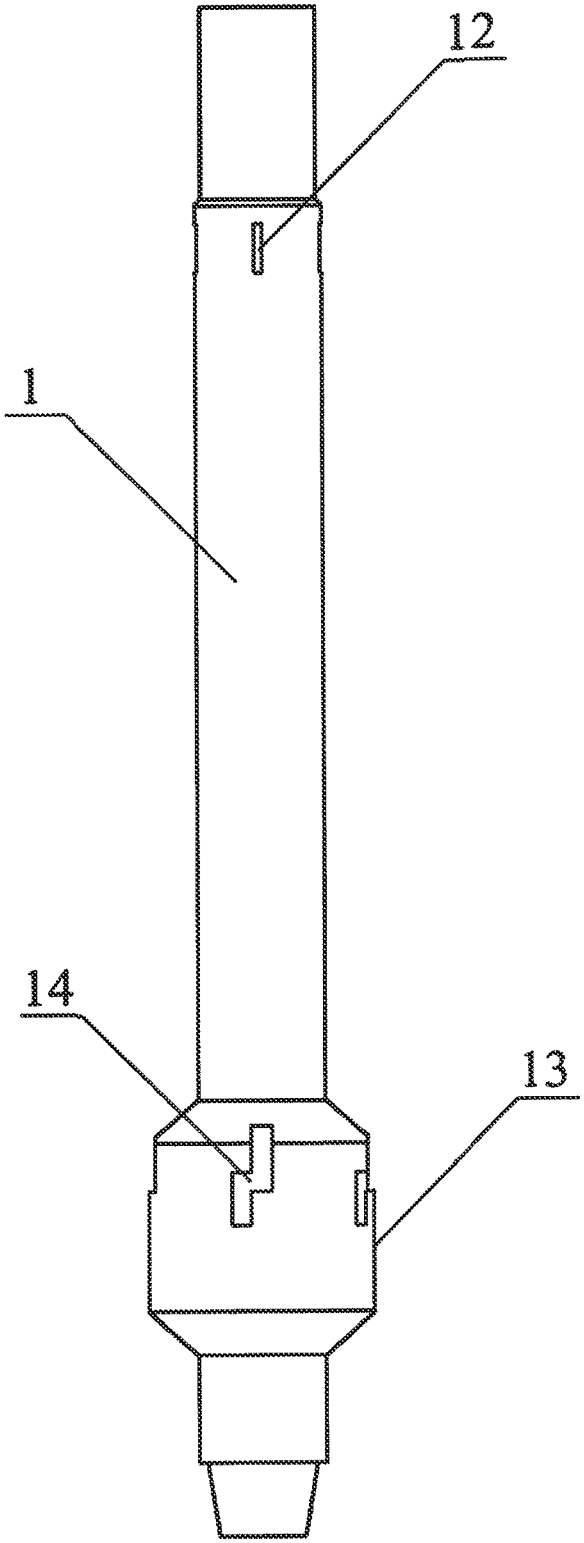
FIG. 5 is a schematic structural diagram of the mandrel.

As shown in FIG. 5, the outer wall at the top end of the mandrel 1 has four identical vertical grooves 12 arranged at the same height and distributed evenly along the circumference; the lower part of the mandrel 1 has a boss 13, the outer wall of which has four identical vertical step grooves 14 arranged at the same height and distributed evenly along the circumference; each step groove 14 includes one horizontal groove and two vertical grooves, wherein the horizontal groove is an arc groove in the circumferential direction, both vertical grooves are located at both ends of the horizontal groove and extend from both ends of the horizontal groove in opposite directions, and the vertical groove extending upwards has an opening at its top end.

The inner sleeve 2 is a tubular structure, the inner diameter of the upper part of the inner sleeve 2 is equal to the outer diameter of the upper part of the mandrel 1, and the inner diameter of the lower part of the inner sleeve 2 is equal to the outer diameter of the boss 13 of the mandrel 1; four shear pins 21 are fixed to the top end of the inner sleeve 2 at the same height and are distributed symmetrically along the circumference, and the four shear pins 21 extend into the vertical grooves 12 in the upper part of the mandrel 1, so that the inner sleeve 2 can move up and down axially only but cannot rotate in relation to the mandrel 1.

Four positioning keys 22 are fixed to the inner wall at the bottom end of the inner sleeve 2 at the same height, and are evenly distributed along the circumference; the positioning keys 22 are inserted into the step grooves 14 in the lower part of the mandrel 1, so that the mandrel 1 can drive the inner sleeve 9 to rotate together when the positioning keys 22 are located in the downward vertical grooves of the step grooves 14; when the mandrel 1 is lowered, the positioning keys 22 will slide upwards in the downward vertical grooves of the step grooves 14; when the positioning keys 22 reach the left ends of the horizontal grooves (the mandrel is rotated in clockwise direction when viewed from above), the four shear pins 21 on the upper part of the inner sleeve 2 will be sheared off, and the positioning keys 22 can slide in the horizontal grooves; if the mandrel 1 is lowered when the positioning keys 22 reach the right ends of the horizontal grooves, the positioning keys 22 will slide out from the opening at the upper ends of the vertical grooves, so that the mandrel 1 disengages from the inner sleeve 2.

The outer wall at the middle part of the inner sleeve 2 has trapezoid transmission threads.

The outer sleeve 3 is a tubular structure, the inner diameter of the upper part of the outer sleeve 3 is equal to the outer diameter of the upper part of the inner sleeve 2, the lower part of the inner wall of the outer sleeve 3 has trapezoid transmission threads, which are engaged with the transmission threads on the outer wall of the inner sleeve 2; when the inner sleeve 2 rotates, the outer sleeve 3 will be driven via the transmission threads to slide in axial direction. The middle part of the outer wall of the outer sleeve has an annular reducing groove 32, the groove depth of which increases from top to bottom.

Figure 4:
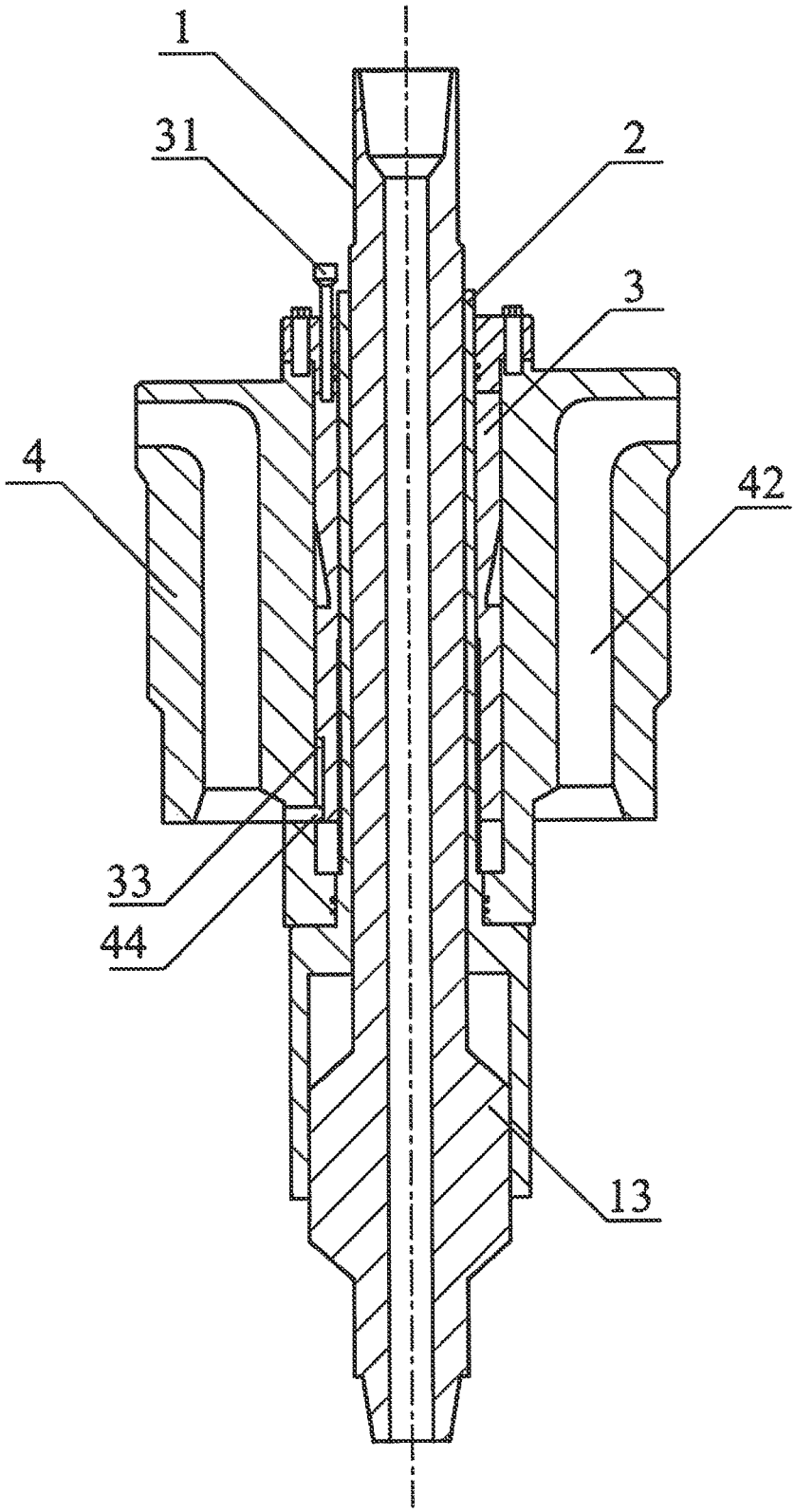
FIG. 4 is a sectional view taken along line C-C of the structure in FIG. 2.

As shown in FIG. 4, a columnar indication rod 31 is fixed to the top of the outer sleeve 3 via threads. When the outer sleeve 3 slides in axial direction, the vertical position of the outer sleeve 3 can be learned in real time by observing the position of the top end of the indication rod 31. The outer wall of the lower part has an anti-rotation groove 33 in vertical direction.

The main body 4 is a hollow cylinder structure, the inner diameter of the main body 4 is larger at the upper part and smaller at the lower part, the inner diameter of the upper part is equal to the outer diameter of the outer sleeve 3, the inner diameter of the lower part is equal to the outer diameter of the inner sleeve 2, the clearance between the inner diameter of the lower part of the main body 4 and the outer diameter of the inner sleeve 2 is sealed by an O-ring seal.

The main body 4 is situated on the boss 13 of the inner sleeve 2, the main body 4 and the inner sleeve 2 form a cavity in which the outer sleeve 3 is arranged. The main body 4 has eight flow-back holes 42 arranged symmetrically along the circumference, and the flow-back holes 42 serve as flow-back channels for the drilling fluid carrying rock cuttings, so that the drilling fluid flows into the main body from the lower part of the main body 4 in axial direction, and then flows out radially in horizontal direction; the bottom surface of the main body 4 is provided with four rib plates 45 arranged radially and distributed evenly along the circumference.

The inner diameter of a sealing cap 41 is equal to the outer diameter of the upper part of the inner sleeve 2, the sealing cap 41 is fitted over the inner sleeve 2 and is fixed to the top surface of the main body 4 by eight screws symmetrically distributed along the circumference, and the clearance between the sealing cap 41 and the inner sleeve 2 is sealed by an O-ring seal.

An anti-rotation pin 44 penetrates the main body 1 and is inserted into an anti-rotation groove 33 on the outer sleeve 3, so that the outer sleeve 3 an move up and down in the main body 4 only, but cannot rotate.

Eight retaining pawls 43 are arranged radially on the middle part of the main body 4 and are evenly distributed along the circumference, the retaining pawls 43 can slide radially in the main body 4, the inner end of the retaining pawl 43 is in a semi-spherical shape, and the outer end of the retaining pawl 43 has three horizontal protruding claws. When the outer sleeve 3 slides downwards, the inner end surface of the retaining pawl 44 can be pushed out along the inclined surface of the reducing groove 32.

The outer diameter of the main body 4 is varying, larger at the upper part and smaller at the lower part.

Figure 6:
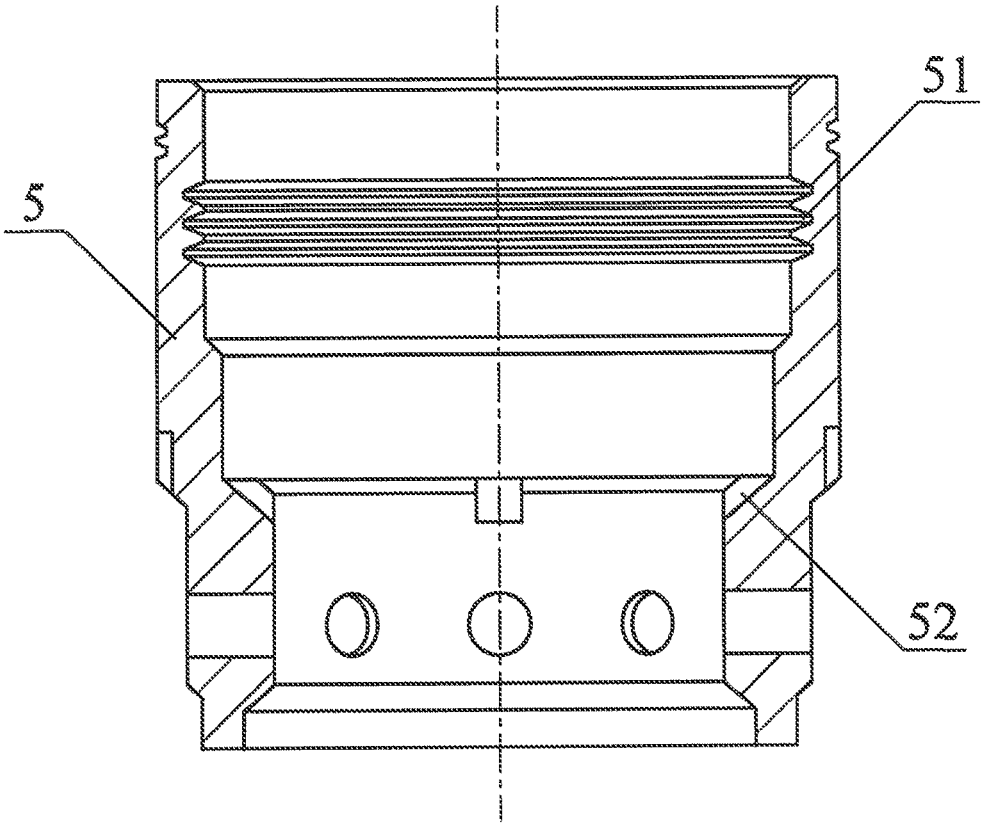
FIG. 6 is a sectional view of the conductor head.
Figure 7:
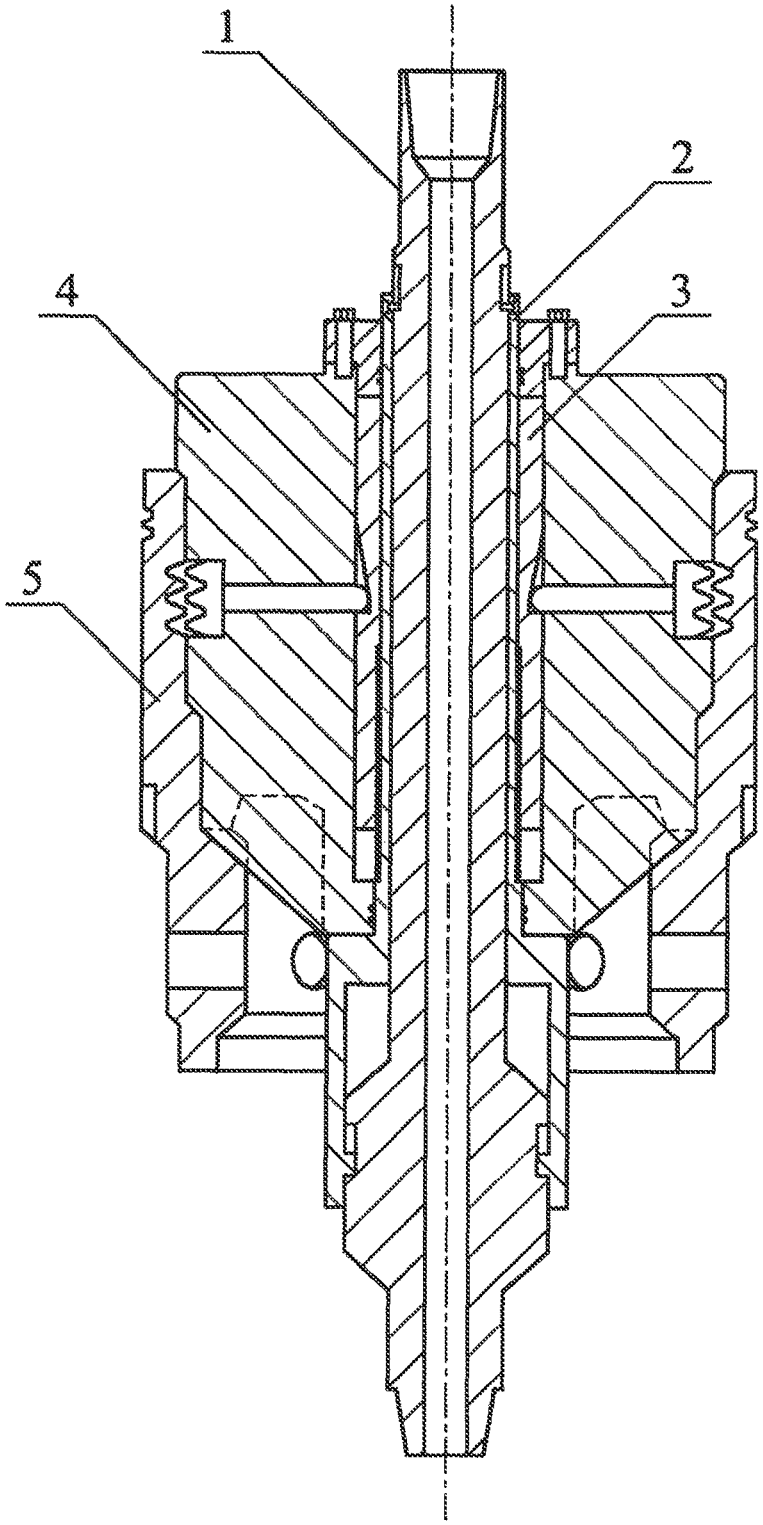
FIG. 7 is a schematic diagram illustrating the fitting between the surface layer conductor running tool for deep-water well drilling and the conductor head.

As shown in FIG. 6, the conductor head 5 is a tubular structure, the lower end of which is welded to the conductor; the inner diameter of the conductor head 5 is larger at the upper part and smaller at the lower part, and the inner diameter at the upper part matches the outer diameter of the lower part of the main body 4. The main body 4 can be set and sealed in the conductor head 5. The upper part of the inner wall of the conductor head 5 has three annular grooves 51. When the retaining pawls 43 are pushed out, they can be embedded partially into the annular grooves 51, so that the tool is fixed and cannot move up. The step surface of the lower part of the conductor head 5 has four inclined grooves 52 arranged radially and distributed symmetrically along the circumference; the rib plates 45 are inserted into the inclined grooves 52 of the conductor head 5, so as to fix the tool and prevent it from rotation cannot.

The working principle of the surface layer conductor running tool for deep-water well drilling is explained as follows.

In the initial state, the mandrel and the upper part of the inner sleeve are fixed together by the fitting between the shear pins and the vertical grooves, the positioning keys on the lower part of the inner sleeve are at the bottom ends of the vertical grooves below the step grooves of the mandrel, the outer sleeve is at the upper part in the cavity of the main body, and the outer ends of the retaining pawls are in the main body and do not protrude out.

The surface layer conductor running tool for deep-water well drilling is run to the step surface in the conductor head and set there, with the rib plates on the main body situated in the inclined grooves on the conductor head. The mandrel is turned in counter clockwise direction (viewed from above), so that the inner sleeve is driven to rotate for 4~5 circles, and the outer sleeve moves downwards under the action of the transmission threads. Now, the retaining pawls are pushed out by the inclined surface of the reducing groove on the outer sleeve, and are embedded into the annular groove on the inner wall of the conductor head, and thereby fix the main body in the conductor head. Thus, the running tool and the conductor head are in a locked state.

The conductor running work by conductor jetting can be carried out now. After the surface layer conductor is run to a designated position, the conductor is held in still state for a while, till the bearing capacity of the formation is recovered; then, the mandrel should be released as follows. First, the mandrel is turned in clockwise direction (viewed from above), so that the inner sleeve is driven to rotate for 4~5 circles, and the outer sleeve moves upwards under the action of the transmission threads. Now, the retaining pawls can slide inwards, and the running tool and the conductor head are in an unlocked state.

The mandrel is lowered. When the positioning keys reach the upper ends of the vertical grooves below the step grooves, the mandrel is turned in clockwise direction (viewed from above), so that the shear pins on the upper part of the inner sleeve are sheared off under the action of shearing force. When the positioning keys reach the lower ends of the vertical grooves above the step grooves, the mandrel is lowered again. Now, the mandrel disengages from the inner sleeve, and further drilling work can be continued. After the further drilling work is finished, the mandrel is lifted up, and the bottom-hole assembly and the tool are lifted to the platform; thus, the deep-water well drilling of the surface layer section is completed.

What is claimed is:

1. A surface layer conductor running tool for deep-water well drilling, comprising: a mandrel, an inner sleeve, an outer sleeve, and a main body, wherein the inner sleeve, the outer sleeve, and the main body are fitted over the mandrel sequentially; the inner sleeve is configured to slide up and down but is configured to not rotate in relation to the mandrel, the outer sleeve and the inner sleeve are connected via a transmission thread pair, and the main body is situated on the inner sleeve; at least one retaining pawl penetrating the main body and radially slidable in horizontal direction; and an anti-rotation pin penetrating the main body and the outer sleeve, so that the outer sleeve is configured to move up and down in the main body only, but is configured to not rotate;

the main body and the inner sleeve form a cavity in which the outer sleeve is located; the main body has eight flow-back holes distributed symmetrical along the circumference, a bottom surface of the main body has four rib plates arranged radially and distributed evenly along the circumference, the at least one retaining pawl includes eight retaining pawls, the eight retaining pawls are arranged radially on a middle part of the main body and are evenly distributed along the circumference, the retaining pawls are configured to slide radially in the main body, an inner end of each of the retaining pawls is in a semi-spherical shape configured to engage the outer sleeve, and an outer end of each of the retaining pawls has three horizontal protruding claws configured to engage the conductor; an outer diameter of the main body is varying, larger at an upper part and smaller at a lower part.

2. The surface layer conductor running tool for deep-water well drilling according to claim 1, wherein the mandrel is a hollow mandrel and has a center hole, an upper end of the mandrel has internal threads, and a lower end of the mandrel has external threads; an outer wall at a top end of the mandrel has four identical vertical grooves arranged at the same height and distributed evenly along the circumference; a lower part of the mandrel has a boss, the outer wall of which has four identical vertical step grooves arranged at the same height and distributed evenly along the circumference; each step groove includes one horizontal groove and two vertical grooves, wherein the horizontal groove is an arc groove in the circumferential direction, both vertical grooves are located at both ends of the horizontal groove and extend from both ends of the horizontal groove in opposite directions, and the vertical groove extending upwards has an opening at its top end.

3. The surface layer conductor running tool for deep-water well drilling according to claim 2, wherein the inner sleeve is a tubular structure, an inner diameter of a upper part of the inner sleeve is equal to an outer diameter of the upper part of the mandrel, and an inner diameter of a lower part of the inner sleeve is equal to the outer diameter of the boss of the mandrel; four shear pins are fixed to a top end of the inner sleeve at the same height and are distributed symmetrically along the circumference, and the four shear pins extend into the vertical grooves in the upper part of the mandrel, so that the inner sleeve is configured to move up and down axially only but is configured to not rotate in relation to the mandrel.

4. The surface layer conductor running tool for deep-water well drilling according to claim 3, wherein four positioning keys are fixed to an inner wall at a bottom end of the inner sleeve at the same height, and are evenly distributed along the circumference; the positioning keys are inserted into the step grooves in the lower part of the mandrel; an outer wall at a middle part of the inner sleeve has trapezoid transmission threads.

5. The surface layer conductor running tool for deep-water well drilling according to claim 4, wherein the outer sleeve is a tubular structure, an inner diameter of an upper part of the outer sleeve is equal to an outer diameter of the upper part of the inner sleeve, the lower part of an inner wall of the outer sleeve has trapezoid transmission threads, which are engaged with the transmission threads on the outer wall of the inner sleeve; a middle part of an outer wall of the outer sleeve has an annular reducing groove, the groove depth of which increases from top to bottom.

6. The surface layer conductor running tool for deep-water well drilling according to claim 5, wherein a columnar indication rod is fixed to a top of the outer sleeve via threads, an anti-rotation groove in vertical direction is arranged in the outer wall of the lower part.

7. The surface layer conductor running tool for deep-water well drilling according to claim 6, wherein the main body is a hollow cylinder structure, an inner diameter of the main body is larger at the upper part and smaller at the lower part, the inner diameter of the upper part is equal to the outer diameter of the outer sleeve, the inner diameter of the lower part is equal to the outer diameter of the inner sleeve, the clearance between the inner diameter of the lower part of the main body and the outer diameter of the inner sleeve is sealed by an O-ring seal.

8. The surface layer conductor running tool for deep-water well drilling according to claim 7, wherein an inner diameter of a sealing cap is equal to the outer diameter of the upper part of the inner sleeve, the sealing cap is fitted over the inner sleeve and is fixed to the top surface of the main body by eight screws symmetrically distributed along the circumference, and the clearance between the sealing cap and the inner sleeve is sealed by an O-ring seal.

* * * * *